US011806566B2

(12) United States Patent
Riad et al.

(10) Patent No.: US 11,806,566 B2
(45) Date of Patent: Nov. 7, 2023

(54) DEVICE FOR ARM-STRENGTH TRAINING

(71) Applicant: No Conformity Co, LLC, Cary, NC (US)

(72) Inventors: Andrew Riad, Cary, NC (US); Patrick Brian Murphy, Anderson, SC (US)

(73) Assignee: NO CONFORMITY CO, LLC, Cary, NC (US)

( * ) Notice: Subject to any disclaimer, the term of this patent is extended or adjusted under 35 U.S.C. 154(b) by 69 days.

(21) Appl. No.: 17/406,485

(22) Filed: Aug. 19, 2021

(65) Prior Publication Data

US 2023/0059213 A1 Feb. 23, 2023

(51) Int. Cl.

| | |
|---|---|
| ***A63B 21/00*** | (2006.01) |
| ***A63B 23/035*** | (2006.01) |
| ***A63B 23/12*** | (2006.01) |

(52) U.S. Cl.

CPC .... *A63B 21/00181* (2013.01); *A63B 21/4007* (2015.10); *A63B 21/4039* (2015.10); *A63B 23/03516* (2013.01); *A63B 23/12* (2013.01)

(58) Field of Classification Search

CPC ..... A63B 21/00181; A63B 21/00047; A63B 21/04; A63B 21/065; A63B 21/4007; A63B 21/4017; A63B 21/4039; A63B 23/03616; A63B 23/12; A63B 23/1281; A63B 69/0059

See application file for complete search history.

(56) References Cited

U.S. PATENT DOCUMENTS

| | | | | | |
|---|---|---|---|---|---|
| 3,679,107 | A * | 7/1972 | Perrine | A45F 3/14 | 482/106 |
| 3,724,846 | A * | 4/1973 | Perrine | A63B 71/12 | 482/106 |
| 4,521,011 | A * | 6/1985 | Solloway | A63B 31/14 | 441/59 |
| 4,576,155 | A * | 3/1986 | Levy | A61F 5/00 | 128/869 |
| 4,629,183 | A * | 12/1986 | Perrine | A63B 21/0724 | 482/106 |
| 4,676,502 | A * | 6/1987 | Mahr | A63B 21/065 | 482/106 |
| 4,722,524 | A * | 2/1988 | Waszkelewicz | A63B 21/0724 | 482/106 |
| 4,799,675 | A * | 1/1989 | Helmer | A63B 21/0724 | 482/106 |
| 4,896,887 | A * | 1/1990 | Cable | A63B 69/0059 | 473/212 |

(Continued)

*Primary Examiner* — Loan B Jimenez
*Assistant Examiner* — Zachary T Moore
(74) *Attorney, Agent, or Firm* — NK Patent Law

(57) ABSTRACT

A training device useful at least for exercises for bicep workouts and strengthening is configurable for multiple types of movement and use. The training device has a frame, two arm cradles attached in variable configurations, and a multi-use strap. The arm cradles are removable from the frame for re-configuration or for storage and transport. To configure the training device for compact storage and transportation, the arm cradles can be detached, nestled into the inner side of the frame, and wrapped by the strap. To attain various workout configurations, the arm cradles can be interchanged on the frame, reoriented on the frame, and adjusted to preferred lateral positions on the frame.

19 Claims, 12 Drawing Sheets

(56) References Cited

U.S. PATENT DOCUMENTS

| | | | | |
|---|---|---|---|---|
| 5,005,832 | A * | 4/1991 | Van Der Hoeven | A63B 21/154 482/124 |
| 5,058,886 | A * | 10/1991 | Jackson | A63B 21/0724 482/106 |
| 5,167,600 | A * | 12/1992 | Baird | A63B 21/065 482/93 |
| 5,337,737 | A * | 8/1994 | Rubin | A63B 23/1281 482/111 |
| 6,247,982 | B1 * | 6/2001 | Walker | A63B 31/11 441/64 |
| 7,811,216 | B2 * | 10/2010 | Babiarz | A63B 21/00069 482/142 |
| 9,616,267 | B2 * | 4/2017 | Sassano | A63B 21/00043 |
| 10,959,468 | B2 * | 3/2021 | Sasano | A41D 13/0015 |
| 11,135,490 | B2 * | 10/2021 | Pippitt | A63B 23/02 |
| 11,305,147 | B1 * | 4/2022 | Womack | A63B 69/0059 |
| 2013/0040749 | A1 * | 2/2013 | Strand | A63B 69/3608 473/212 |
| 2013/0090182 | A1 * | 4/2013 | Sander | A63B 53/047 473/291 |
| 2014/0171278 | A1 * | 6/2014 | Orenstein | A63B 21/00047 482/141 |
| 2017/0215564 | A1 * | 8/2017 | Sande | A46B 7/042 |

* cited by examiner

DEVICE FOR ARM-STRENGTH TRAINING

TECHNICAL FIELD

The present disclosure relates to exercise devices. More particularly, the present disclosure relates to a portable personal device for arm strengthening exercises.

BACKGROUND

Weightlifting is the second most popular sports activity in the United States, according to a 2016 study. But with the increasing popularity of the sport comes the need for implementation of weight training best practices. For example, proper form must be utilized effectively in order to achieve best results and prevent injury. The reasons for this are many, but chief among them is so that the targeted muscles are being used, and not associated support muscles. For example, during bicep curling, if proper form is not utilized, the exerciser will utilize their shoulders to assist in the curling, which doesn't properly isolate the bicep muscles and the user will rely on momentum to complete the exercise.

Furthermore, free weight bicep curls can place undue stress on the elbows and cause side to side movement, when up and down movement and training of the biceps is desired. Additionally, the muscle will not develop properly if it's not targeted from a variety of angles, which requires that the user undertake many different exercises. Each of the exercises may have the exact same aforementioned targeting and isolation issues associated with the biceps. Thus, a system or device that can provide improvements for stability and structure to the user while free weight training, and adaptability to different exercise routines are desirable.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

A training device, according to at least one embodiment, includes: a frame member including a curved central portion, a first mounting plate extending from a first end of the central portion, and a second mounting plate extending from a second end of the central portion opposite the first end. A first arm cradle and a second arm cradle are each configured for mounting on either mounting plate. In use the first arm cradle is mounted on a user-selected one of the first mounting plate and second mounting plate, and the second arm cradle is mounted on the other of the first mounting plate and second mounting plate.

Each mounting plate may include spaced position slots. The first arm cradle may include a tab for engaging any one of the position slots of the user-selected first mounting plate or second mounting plate; and the second arm cradle may include a tab for releasably engaging any one of the position slots of the other of the first mounting plate and second mounting plate.

The respective tab of each of the first arm cradle and second arm cradle may include a tooth; and the respective tab may be biased into an engagement position by which the tooth thereof clicks into a position slot, thereby releasably locking the arm cradle in an indexed position along the respective mounting plate.

Each tab may include a lever by which a user can flex the tab thereby withdrawing the tooth from the position slot to permit movement of the arm cradle on the mounting plate.

The arm cradles may be constructed as mirror opposites. When the arm cradles are mounted on the mounting plates, the arm cradles can be arranged symmetric across the central portion of the frame member.

In at least one example, the first arm cradle includes a first channel and a second channel, each configured for receiving the user-selected first mounting plate or second mounting plate, the first channel and second channel being angularly offset from each other by an offset angle such that the first arm cradle can be mounted on the frame member in two orientations that differ by the offset angle; and the second arm cradle includes a first channel and a second channel, each configured for receiving the other of the first mounting plate and second mounting plate, the first channel and second channel of the second arm cradle are angularly offset from each other by the offset angle such that the second arm cradle can be mounted on the frame member in two orientations that differ by the offset angle.

The first arm cradle may include a first tab for engaging any one of the position slots of the user-selected first mounting plate or second mounting plate when the first arm cradle is mounted on the frame member by way of the first channel thereof. The first arm cradle may also include a second tab for engaging any one of the position slots of the user-selected first mounting plate or second mounting plate when the first arm cradle is mounted on the frame member by way of the second channel thereof.

The second arm cradle may include a first tab for engaging any one of the position slots of the other one of the first mounting plate and second mounting plate when the second arm cradle is mounted on the frame member by way of the first channel thereof. The second arm cradle may also include a second tab for engaging any one of the position slots of the other one of the first mounting plate and second mounting plate when the second arm cradle is mounted on the frame member by way of the second channel thereof.

The first mounting plate and second mounting plate may extend in opposite lateral directions respectively from the first end and second end of the curved central portion of the frame member.

The first mounting plate and second mounting plate may be coplanar.

An attachment element may be mounted on the frame member, and a strap may be included having at least one attachment element configured for releasably engaging the attachment element of the frame member. In use, the attachment element mounted on the frame member and the at least one attachment element of the strap are releasably engaged by the user.

A strap may be included having a proximal end attached to the frame member.

The strap may include at least one attachment element configured for releasably engaging the frame member, and a distal end opposite the proximal end. The frame member may include at least a first strap slot through which the distal end of the strap is passed to such that the frame member and strap form a loop.

The frame member may include a second strap slot by which the proximal end of the strap is attached to the frame member.

The first strap slot may be defined in a first lateral end of the curved portion of the frame member, from which the first mounting plate extends laterally; and the second strap slot may be defined in a second lateral end of the curved portion of the frame member, from which the second mounting plate extends laterally.

The first mounting and second mounting plate may be coplanar and may extend in opposite lateral directions from the respective first lateral end and second lateral end of the frame member.

A pad mounted may be on the strap. The pad may be movable along the strap to any position preferred by a user.

The training device can be attached to a bench by use of the strap, as the pad adds grip holding the training device securely to the bench.

The training device can be worn around the torso or neck of the user by use of the strap.

Each arm cradle may have a respective padded contact area for supporting a respective arm of the user.

The above summary is to be understood as cumulative and inclusive. The above described embodiments and features are combined in various combinations in whole or in part in one or more other embodiments.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 1:
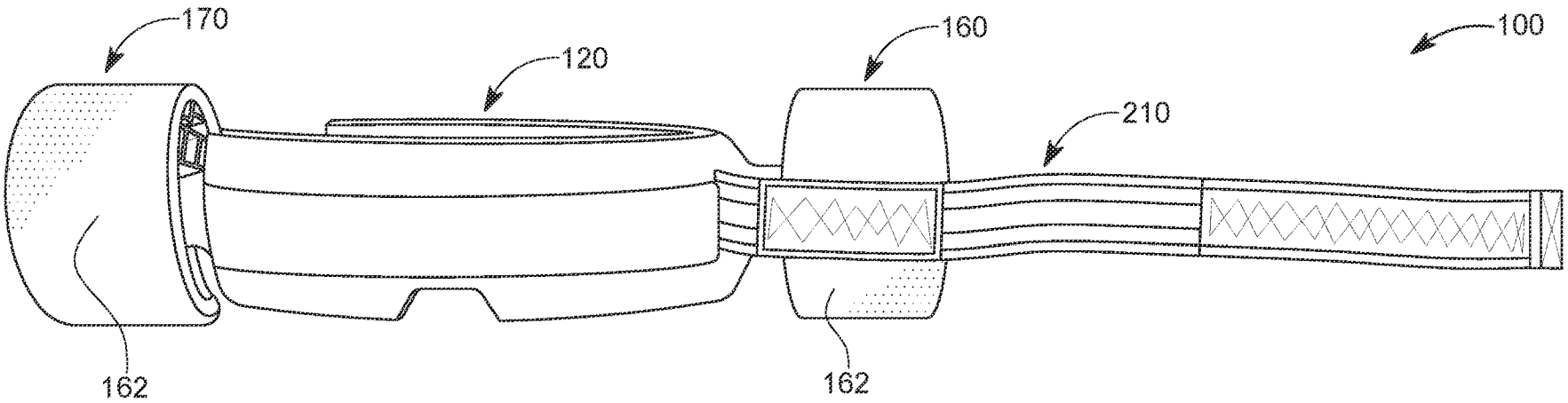
FIG. 1 shows a training device, according to at least one embodiment, with the multi-use strap thereof in a partially condition.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although steps may be expressly described or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a," "an," and "the" refer to "one or more" when used in the subject specification, including the claims. Unless indicated to the contrary, the numerical parameters set forth in the instant specification and attached claims are approximations that can vary depending upon the desired properties sought to be obtained within the scope of these descriptions.

The training device described and illustrated is contemplated as at least useful for exercises for bicep workouts and strengthening. Other uses may come to mind and then be implemented in view of the device, these descriptions, and the referenced drawings. All such uses are within the full scope of this disclosure.

Figure 2:
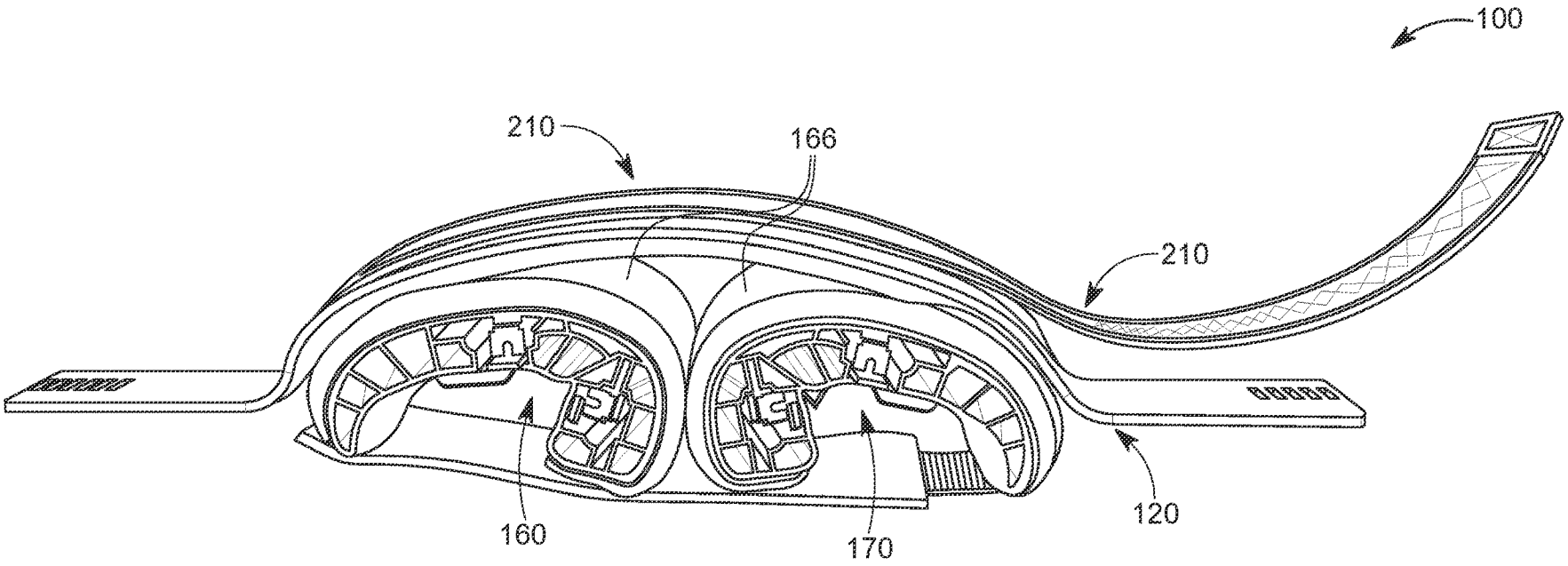
FIG. 2 shows the training device of FIG. 1 in a compact configuration for storage and transport.

FIG. 1 shows a configurable training device 100, according to at least one embodiment, having a frame 120, arm cradles referenced as a first arm cradle 160 and a second arm cradle 170 attached in a first configuration, and a multi-use strap 210 thereof in a partially wrapped condition. The arm cradles 160 and 170 are removable from the frame 120 for re-configuration or for storage and transport. As shown in FIG. 2, to configure the training device 100 for compact storage and transportation, the arm cradles can be detached, nestled into the inner side of the frame 120, and wrapped by the strap 210.

Figure 3:
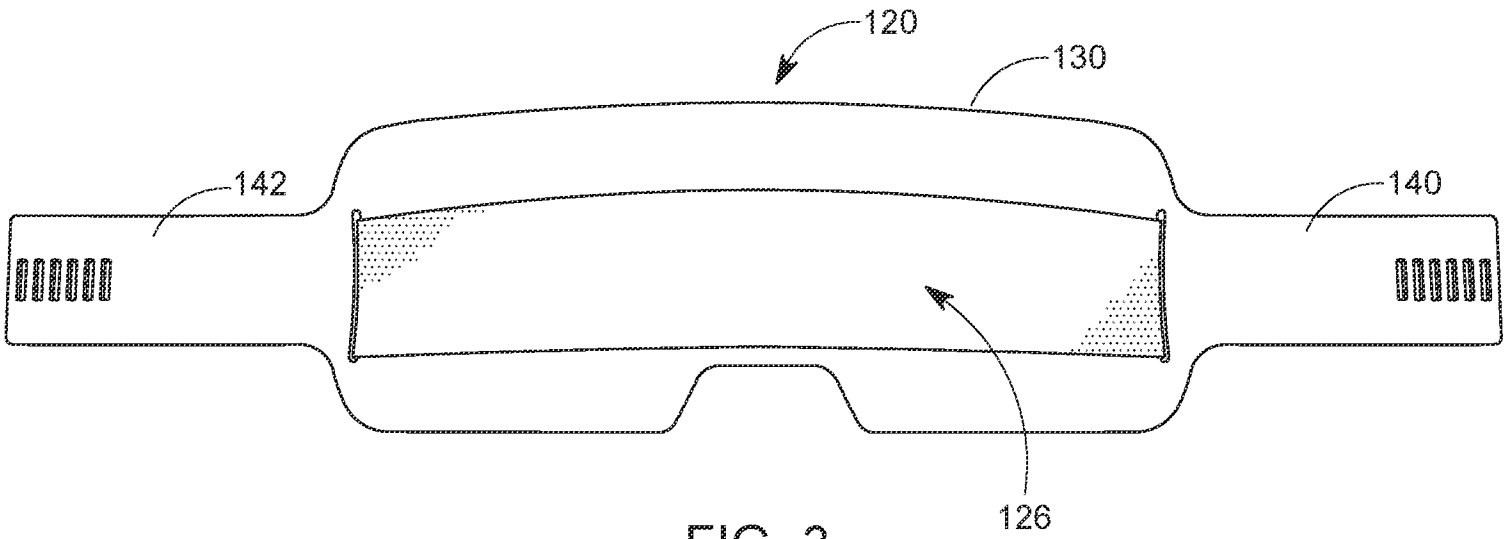
FIG. 3 shows the outer side of the frame of the training device of FIG. 1 without the multi-use strap thereof.
Figure 4:
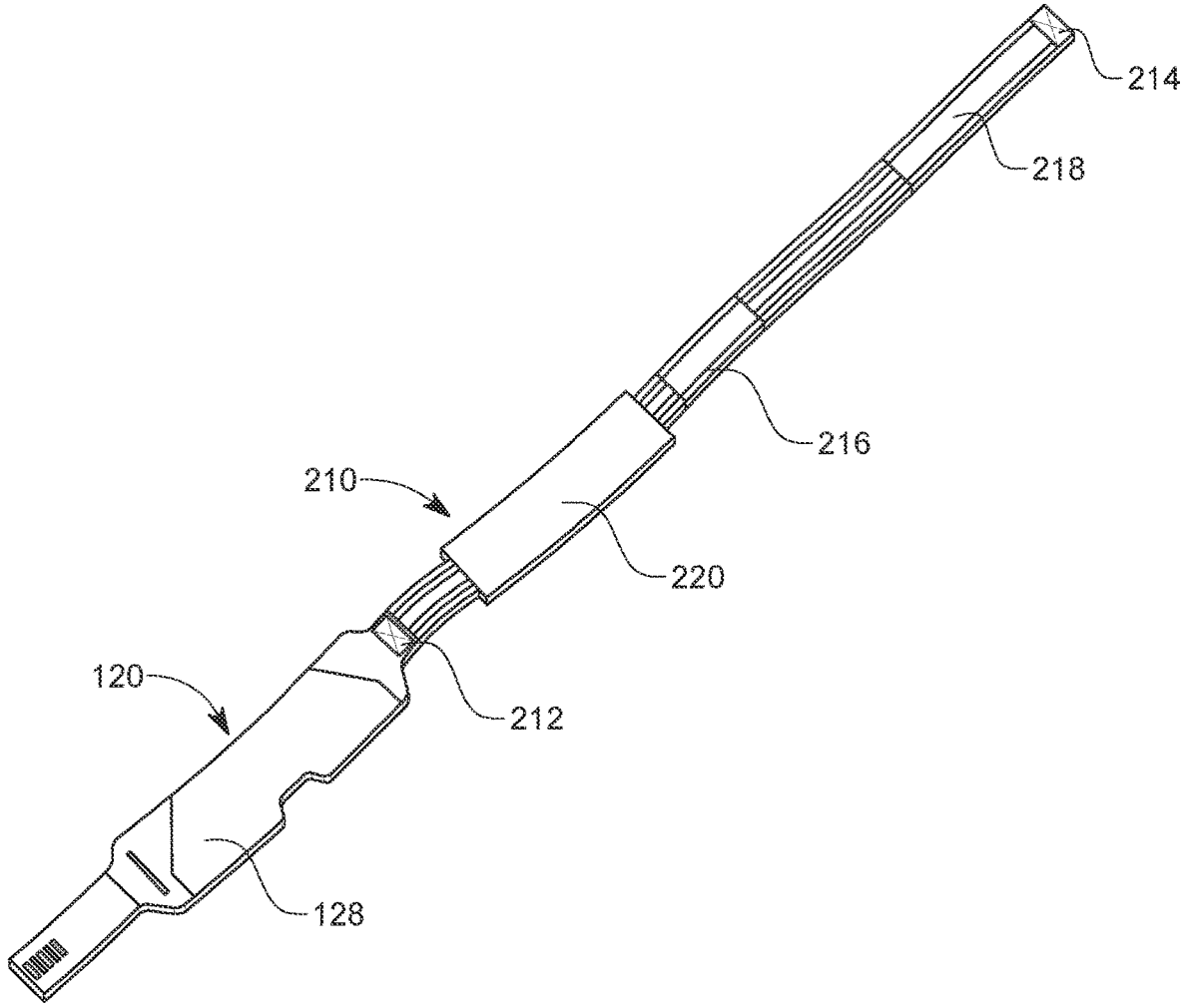
FIG. 4 shows the inner side of the training device of FIG. 1, without the arm cradles, with the strap in a fully extended condition.

As shown in FIG. 3, an attachment element 126 is mounted on the outer side of the frame 120 for releasably and selectively engaging the strap. FIG. 4 shows the inner side of the strap 210 in a fully extended condition. A proximal end 212 of the strap is attached to the frame 120, and a distal end 214 of the strap is shown extended. The strap 210 is shown in FIG. 4 as having two attachment elements, referenced in FIG. 4 as proximal element 216 and a distal element 218, each for selective and removable engagement with the attachment element 126 along the outer side of the frame 120. The strap and frame together form a loop when either of the elements 216 or 218 of the strap engage the element 126 of the frame. The proximal attachment element 216 is used for loops of lesser circumference, and the distal element 218 is used for loops of greater extent. A movable pad 220 can slide, like a sleeve, along the strap 210 to any position preferred by a user. The pad 220 can comfort a user's neck or back according to the placement and use of the strap 210. The pad 220 can also be used to improve grip of the training device when attached to a bench.

The above-described attachment elements can be hook-and-loop fabric portions. For example, the attachment element 126 (FIG. 3) along the outer side of the frame 120 can be a hook type fabric portion, which can be affixed to the frame member by adhesive, and the attachment elements 216 and 218 (FIG. 4) along the strap 210 can be loop type fabric portions.

Figure 5:
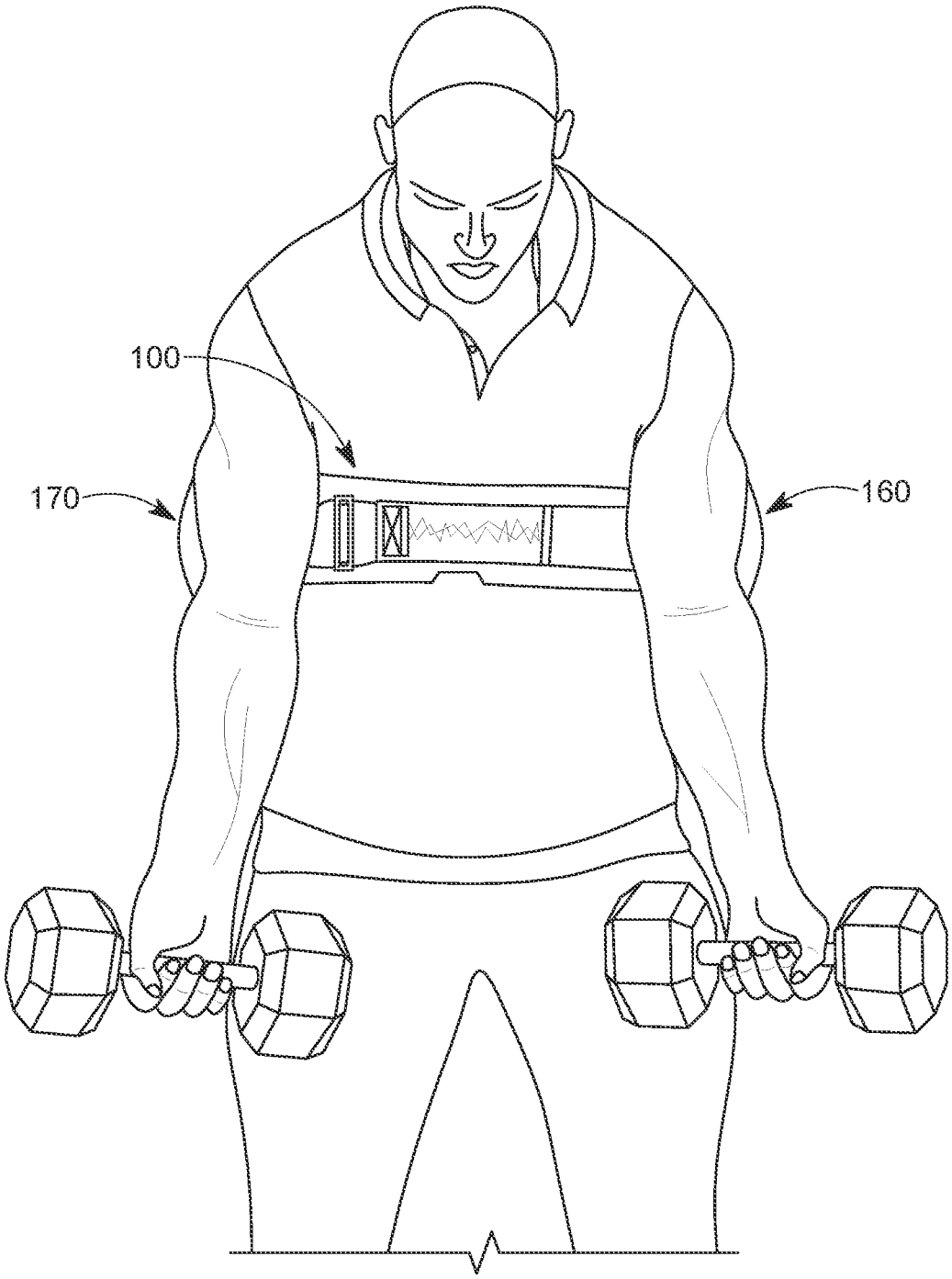
FIG. 5 shows the training device of FIG. 1, with arm cradles thereof in a first-illustrated exercise configuration, and the strap wrapped around the upper torso of a user, as used for example during standing curls with dumbbells.
Figure 6:
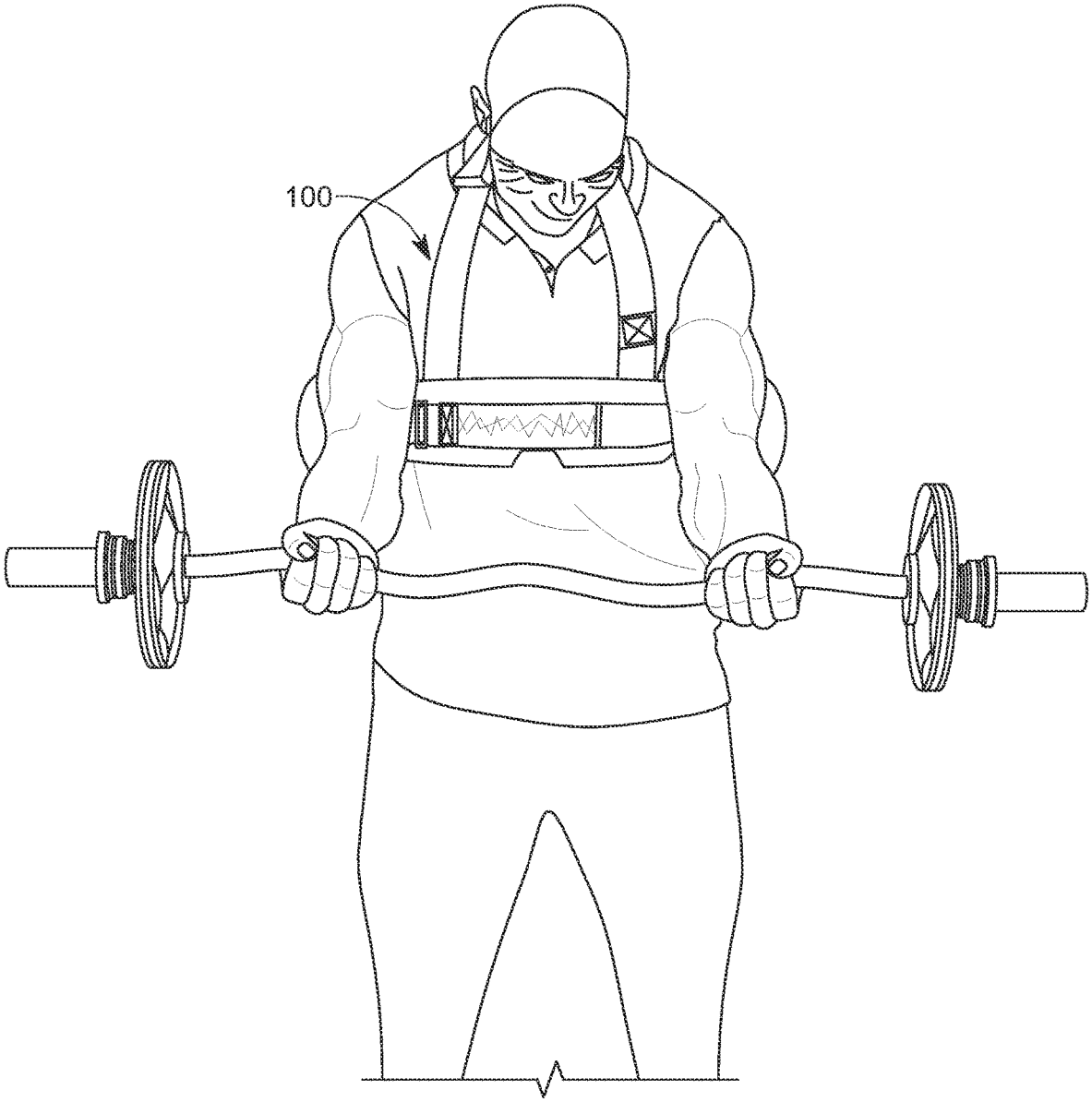
FIG. 6 shows the training device with the arm cradles configured as in FIG. 5, with the device hung from the neck of the user by the strap, as used for example during standing curls with a barbell.

FIG. 5 shows the training device 100 in a first exemplary use with dumbbells, with the strap wrapped around the upper torso of the user. FIG. 6 shows the training device 100 in a second exemplary use with a curl bar. In FIG. 6, the training device 100 is hung from the neck of the user by the strap. The strap is thus re-configurable, for example as shown in FIGS. 5 and 6, by selective use of the proximal and distal attachment elements 216 and 218 engaging the attachment element 126 of the frame 120.

The outer side of each arm cradle has a primary contact area 162 that can be oriented relative to the frame 120 depending on the current or next use of the device. The primary contact area 162, in use for bicep workouts, will typically support (optionally via an attached comfort pad 166) the upper arm opposite the biceps, thus supporting the back or tricep side of the arm. The cradles engage and support the arms to better isolate arm movement so a user can focus on bicep conditioning and strengthening. Each arm cradle (160, 170) has a top side 164, which is directed approximately into or toward the armpit area of the user in FIGS. 5-6 or chest area of the user in FIG. 10. Each top side 164 and opposite bottom side curve away from the primary contact area 162 to define a curved outer form of the cradle to provide comfort and support as the arm of a user rocks and flexes through movements during use, for example as an arm transitions from an extended position (FIG. 5) to a more curled position (FIG. 6).

Figure 7:
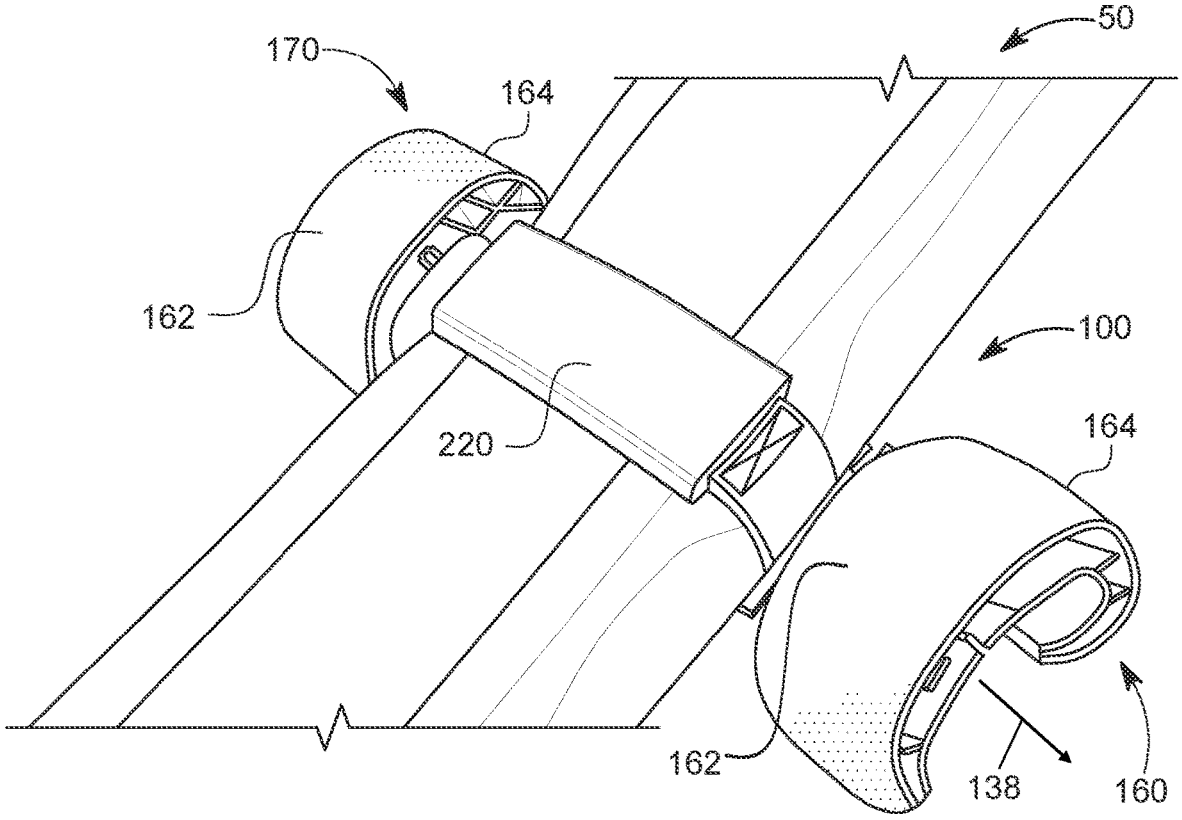
FIG. 7 shows the training device of FIG. 1 removably attached to an inclined bench by the strap, with the arm cradles in a second-illustrated exercise configuration.
Figure 8:
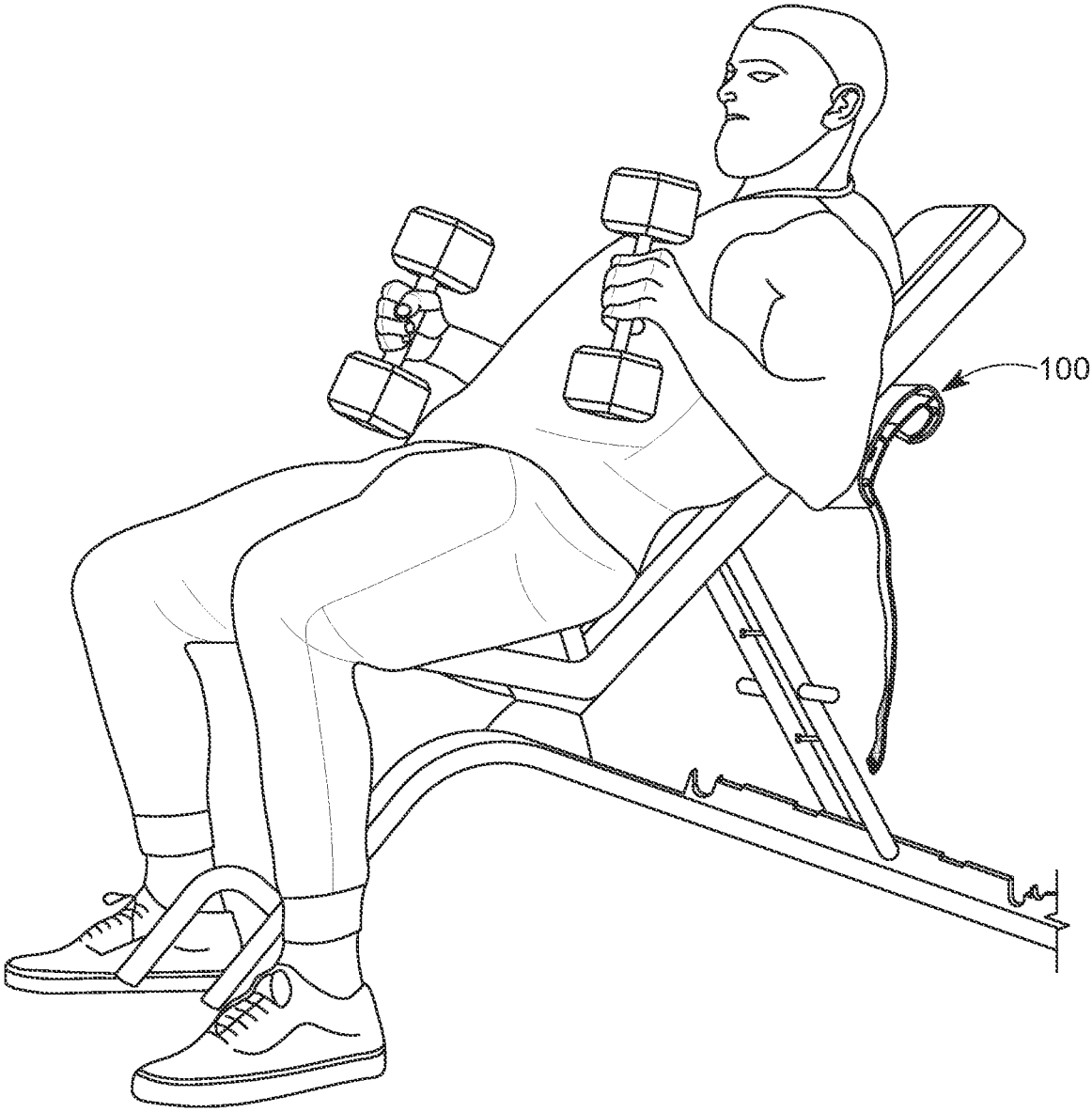
FIG. 8 shows the training device as in FIG. 7 in an exemplary use.
Figure 9:
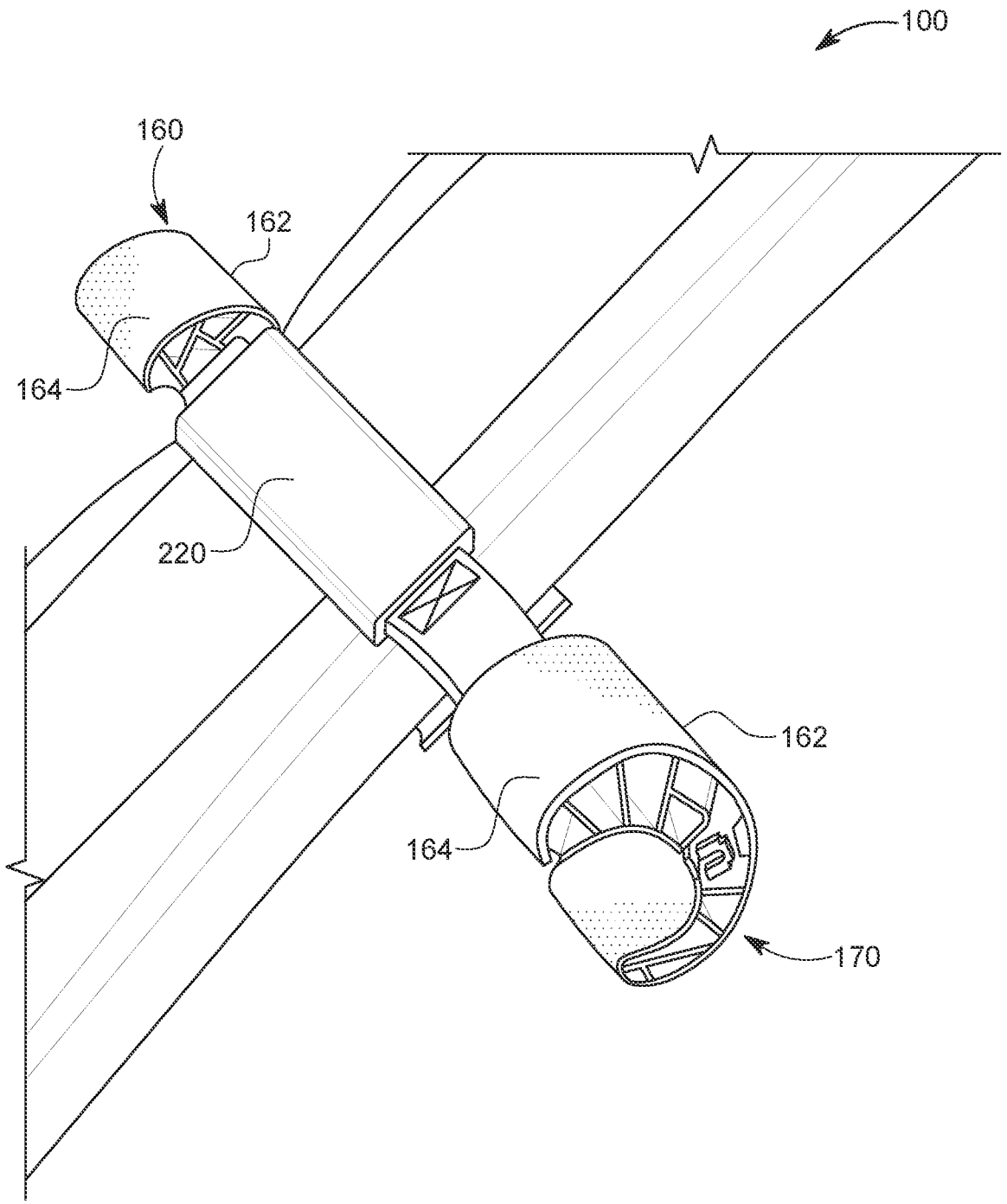
FIG. 9 shows the training device of FIG. 1 removably attached to an inclined bench by the strap, with the arm cradles in a third-illustrated exercise configuration.
Figure 10:
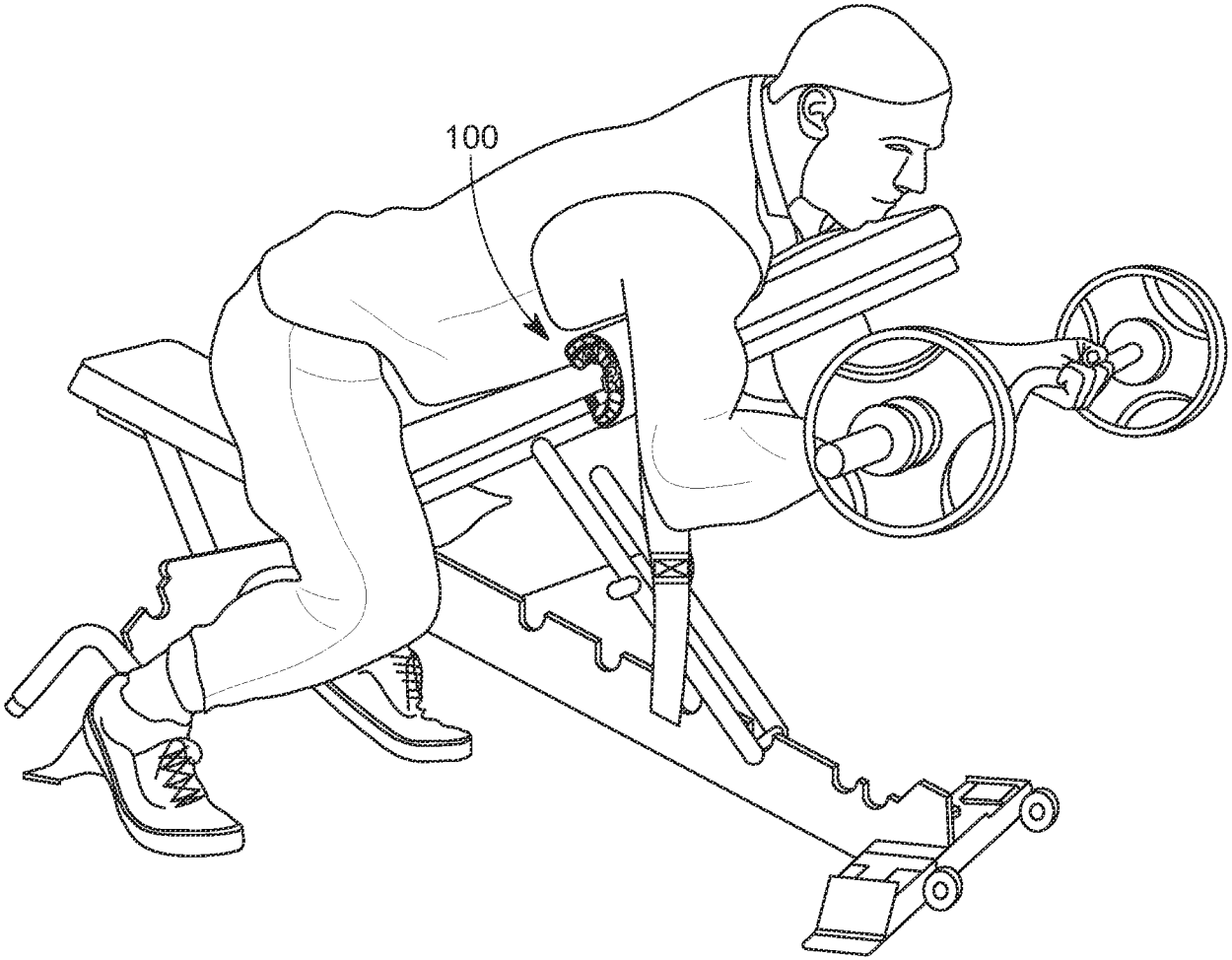
FIG. 10 shows the training device as in FIG. 9 in an exemplary use.

The positions and orientations of the arm cradles 160 and 170 are defined according to where and how they are mounted on the frame as represented by the several configurations of the drawings, which serve as non-limiting examples. FIGS. 5-6 show a first configuration of the arm cradles useful at least for standing curls. FIGS. 7-8 show a second configuration of the arm cradles useful at least for inclined curls. FIGS. 9-10 show a third configuration of the arm cradles useful at least for preacher curls. To transition among the various workout configurations, the arm cradles 160 and 170 are repositioned and/or reoriented on the frame 120, or more particularly, on mounting plates thereof.

Figure 11A:
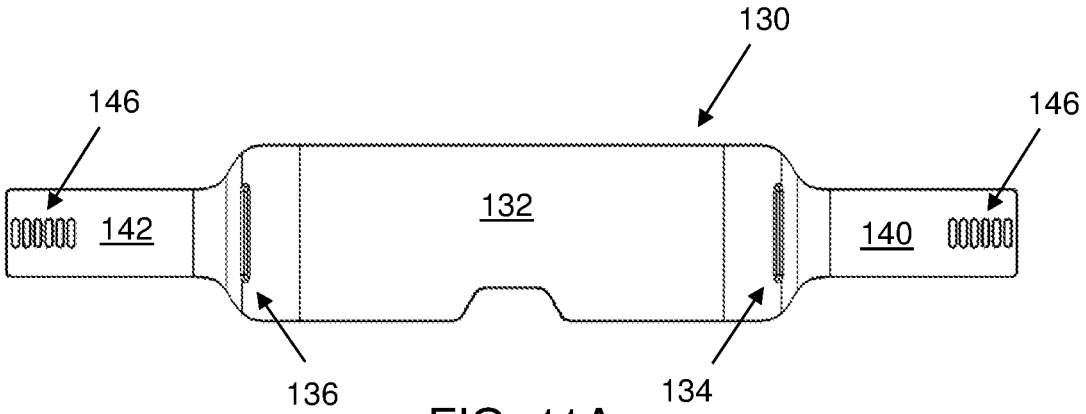
FIG. 11A is a front view of the outer side of a frame member of the training device according to at least one embodiment.
Figure 11B:
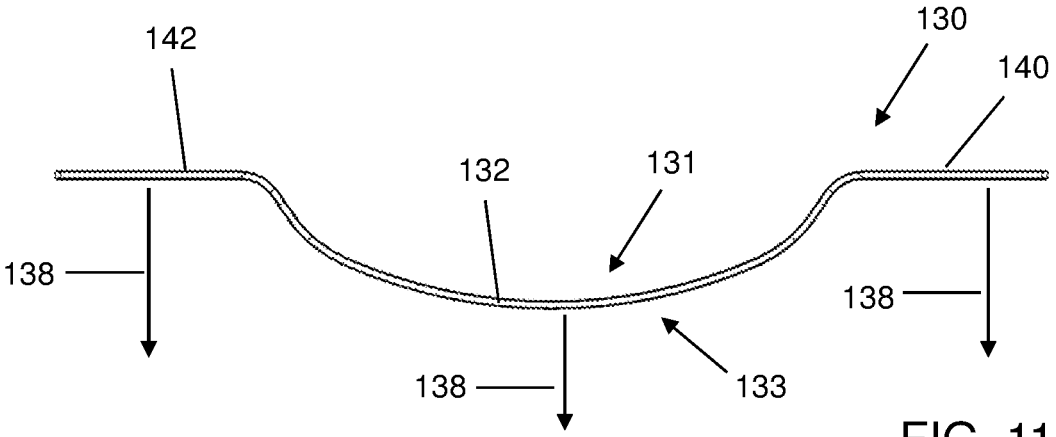
FIG. 11B is a top view of the frame member of FIG. 11A.
Figure 11C:
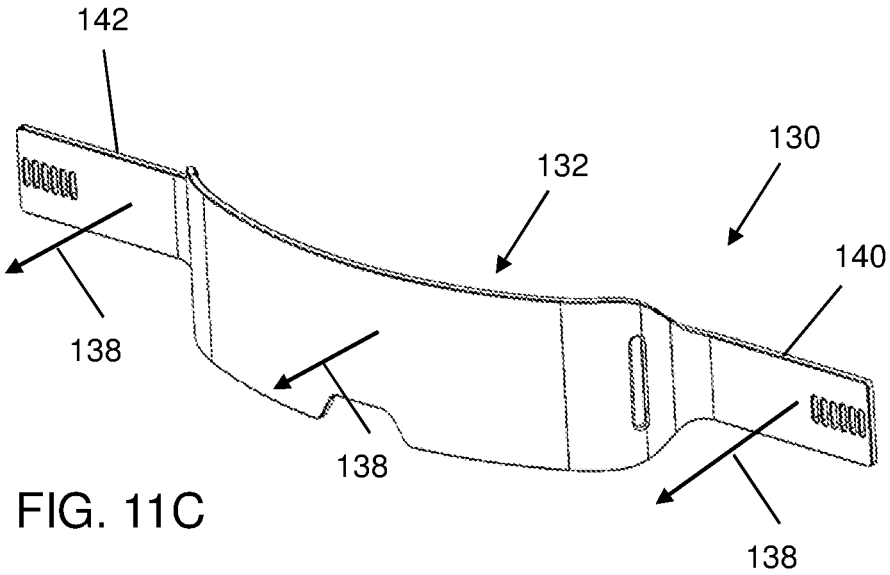
FIG. 11C is a perspective view of the frame member of FIG. 11A.

FIGS. 11A-11B provide views of the frame member 130, without the arm cradles and strap, for illustration of the features of the frame member. In the illustrated embodiment, the frame member 130 is a one-piece item with a curved central portion 132 that is convex along the outer side 133 (FIG. 11B) and concave along the inner side 131. A pair of coplanar mounting plates, referenced as a first mounting plate 140 and a second mounting plate 142, extend laterally outward in opposite lateral directions from opposite ends of the central portion 132.

Each of two opposing lateral ends of the curved central portion 132 of the frame member has a respective strap slot, referenced as a first strap slot 134 (FIG. 11B) and a second strap slot 136, by which the strap variably engages the frame 120. The frame member 130 can be formed as a unitary item of a durable and strong material, such as a steel or aluminum, as non-limiting examples, stamped or die cut and formed, or laser cut. The frame member 130 can be painted or otherwise coated to attain any preferred color.

For consistent convention in these descriptions and in the drawings, a forward direction 138 is defined as directed forward from the frame member 130, in the general direction a user faces having donned the training device 100 as in FIG. 5 with the torso received in the concave inner side 131 of the curved central portion 132 of the frame member 130. The forward direction 138 in the illustrated embodiment is the normal direction of center of the outer side 133 of the frame member 130 and of the mounting plates 140 and 142. The mounting plates 140 and 142 extend in opposite lateral directions, each of which is perpendicular to the forward direction 138.

The cradles 160 and 170 are mounted on the mounting plates in use. Each cradle can be mounted on either mounting plate 140 and 142, a feature that facilitates multi-function aspects of the training device. Each mounting plate 140 and 142 has multiple position slots 146 by which a cradle engages the mounting plate at a variable lateral position along the plate.

The arm cradles 160 and 170 can be interchanged on the mounting plates 140 and 142 in transitioning among some configurations of the training device 100. For example, in use as shown in FIGS. 5-6, the first arm cradle 160 is mounted on the first mounting plate 140 to support the left arm of the user, during standing curls for example; and the second arm cradle 170 is mounted on the second mounting plate 142 to support the right arm. The primary contact areas 162 of the arm cradles 160 and 170 face the forward direction 138 in this configuration.

In use as shown in FIGS. 7-8, the first arm cradle 160 is mounted on the second mounting plate 142 to support the left arm of the user, during inclined curls for example; and the second arm cradle 170 is mounted on the first mounting plate 140 to support the right arm of the user. In transitioning from the configuration of FIGS. 5-6 to that of FIGS. 7-8, the arm cradles 160 and 170 are interchanged on the mounting plates 140 and 142 and are oriented to face their primary contact areas 162 opposite the forward direction 138. The training device 100 is mounted on an inclined bench with the frame member below, and the strap and pad 220 above, the inclined support plank 50 of the bench.

The arm cradles 160 and 170 can also each be mounted on a respective mounting plate in more than one orientation, as exemplified by the configuration illustrated in FIGS. 9-10, which is useful at least for preacher curls. In transitioning from the configuration of FIGS. 5-6 to that of FIGS. 9-10, the arm cradles 160 and 170 are rotated by an offset angle 178, which is described below with reference to FIGS. 12C, and remounted on the mounting plates 140 and 142 respectively.

In the illustrated embodiment of the training device 100, the proximal end 212 (FIG. 4) of the strap 210 is affixed to the frame member by a stitched loop thereof and a double D ring via the second strap slot 136. In use, the distal end 214 of the strap 210 is passed through the first strap slot 134 to form a loop, which is variable according to which of the attachment elements (216, 218) of the strap engages the attachment element 126 along the outer side of the frame, and according to what position of engagement preferred by the user to select the exact length and tension in the loop. To complete the frame 120, the attachment element 126 (FIG. 3) is affixed to the outer side of the frame member 130 and a comfort pad 128 (FIG. 4) is affixed to the inner side thereof.

Figure 12A:
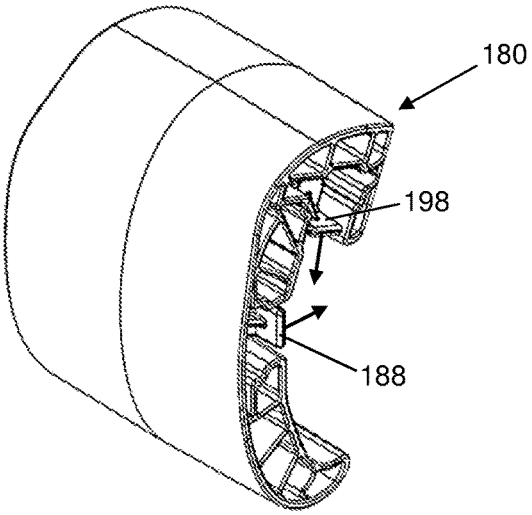
FIG. 12A is a front perspective view of an arm cradle base according to at least one embodiment.
Figure 12B:
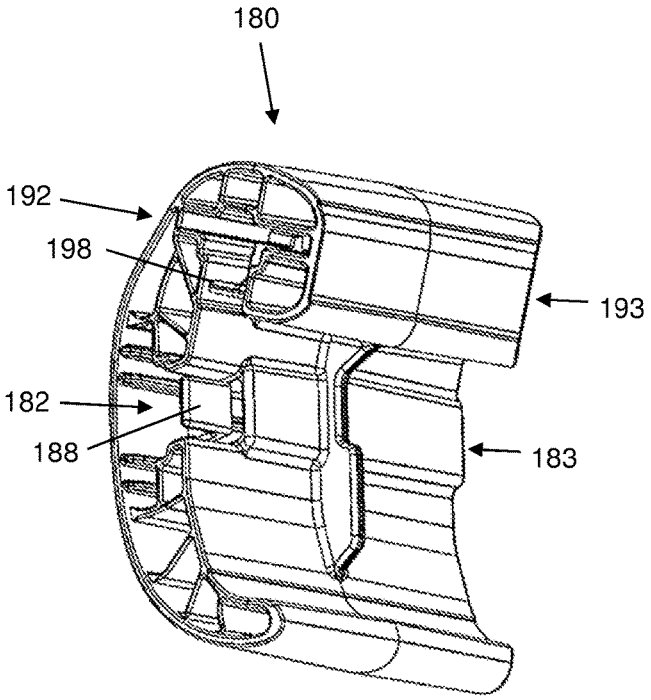
FIG. 12B is a back perspective view of the arm cradle base of FIG. 12A.
Figure 12C:
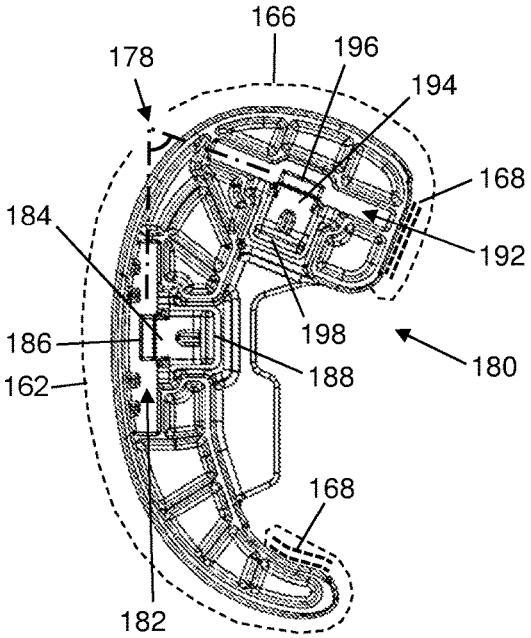
FIG. 12C is a side view of the arm cradle base of FIG. 12A.

An arm cradle base 180 is shown in various views in FIGS. 12A-12C for illustration of its features. The illustrated base 180 is that of the first arm cradle 160 in the drawings, which is mounted on the left side (user left) of the training device 100 for example in FIGS. 5-6. A complete description of one of the two arm cradles is sufficient in these descriptions because the two arm cradles are similarly constructed, but are symmetric across the training device 100. That is, the other arm cradle, referenced as a second arm cradle 170 in the drawings, appears and is constructed as a mirror image or mirror opposite of the first arm cradle 160. The base of the second arm cradle can thus be understood having a shape, appearance, and features that are evident from FIGS. 12A-12C.

The illustrated arm cradle base 180 is skeletonized to be both strong and lightweight. The arm cradles can be constructed of durable injected-molded plastic or composite material as non-limiting examples. Two channels are defined for receiving a mounting plate of the frame to mount an arm cradle thereon.

A first channel 182 (FIG. 12C) is used to mount the arm cradle on the frame as in FIGS. 1 and 5-6 in which the primary contact area 162 of each arm cradle is directed the forward direction 138. The first channel 182 is also used in FIGS. 7-8, in which the primary contact area 162 of each arm cradle is directed opposite the forward direction 138.

A second channel 192 is used to mount the arm cradle on the frame as in FIGS. 9-10, in which the primary contact area 162 is rotated upward relative to the forward direction. The second channel 192 is angularly offset relative to the first channel 182 by an offset angle 178 (FIG. 12C), which is seventy degrees in the illustrated embodiment.

The user selects an optimal orientation for the arm cradles by alternate use of the mounting plates 140 and 142, and of the first and second channels 182 and 192. For example, the primary contact areas 162 of the arm cradles 160 and 170 face the forward direction 138 away from the user when mounted by way of the first channels 182 as in FIGS. 1 and 5-6. In contrast, the primary contact areas 162 of the arm cradles 160 and 170 face opposite the forward direction 138 and toward the user when mounted by way of the first channels 182 as in FIGS. 7-8. In FIGS. 9-10, however, the arm cradles are mounted on the respective mounting plates by way of the second channels 192. Thus, in FIGS. 9-10, the primary contact areas 162 of the arm cradles 160 and 170 face upward or are inclined from the forward direction 138 by the offset angle 178.

A respective locking tab, referenced as a first locking tab 184 for use with the first channel 182, and a second locking tab 194 for use with the second channel 192, is mounted to engage the position slots 146 of the respective mounting plate. By releasably engaging the positions slots 146 of a mounting plate, the locking tabs releasably lock the arm cradle in either configuration and in an indexed lateral position on the mounting plate as selected by a user. Each locking tab 184 and 194 is self-biased into an engagement position by which a respective tooth (186 and 196) thereof clicks into a position slot 146 thereby releasably locking the arm cradle in the indexed lateral position defined by the particular position slot. The locking tabs 184 and 194 are resilient and flexible to permit a user to gently flex the tab out of engagement as shown by the direction arrows in FIG. 12A. Each locking tab 184 and 194 has a laterally outward extending respective lever (188 and 198), by which the user can flex the tab thereby unlocking the cradle from engagement by withdrawing the tooth to permit movement of the arm cradle on the mounting plate.

To complete the arm cradle, with reference to either the first arm cradle 160 or second arm cradle 170, a comfort pad 166 (FIG. 2) is attached to the outer side of the base along the primary contact area 162, for example by hook-and-loop fabric attachments 168 (FIG. 12C) along the margins of the top side 164 and opposite bottom side of the cradle. The comfort pad 166, which typically bears weight during use, is thus removable for cleaning, servicing, or replacement.

That the padded arm cradles 160 and 170 are each constructed as a mirror image of the other, thereby being symmetric across the training device 100 when mounted on the frame, is advantageous. When mounting, each arm cradle 160 and 170 can be oriented, as in all drawings herein showing them mounted, with the levers extending in lateral directions away from the central portion 132 of the frame member. This positions both of the levers 188 and 198 of each arm cradle for easy access by the user. To facilitate such advantageous mounting, each arm cradle 160 and 170 should be mounted on a respective mounting plate of the frame by inserting the mounting plate into the selected channel 182 or 192 from the entry side of the channel. That is, as shown in FIG. 12B, the channel 182 has a suggested entry side 183, which is laterally opposite the lever 188. Similarly, as shown in FIG. 12B, the channel 192 has a suggested entry side 193, which is laterally opposite the lever 198.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A training device comprising:

a frame member comprising a curved central portion, a first mounting plate extending from a first end of the central portion, and a second mounting plate extending from a second end of the central portion opposite the first end, wherein the first mounting plate and second mounting plate extend in opposite lateral directions respectively from the first end and second end of the curved central portion of the frame member and wherein both of the mounting plates have a first surface and opposed second surface, each surface extending in a plane parallel to the lateral direction in which the respective mounting plate extends; and a first arm cradle and a second arm cradle, each configured for mounting on either surface of either mounting plate, wherein, in use the first arm cradle is mounted on a user-selected one of the first mounting plate and second mounting plate, and the second arm cradle is mounted on the other of the first mounting plate and second mounting plate.

2. The training device of claim 1, wherein:

each mounting plate comprises spaced position slots;

the first arm cradle comprises a tab for engaging any one of the position slots of the user-selected first mounting plate or second mounting plate; and the second arm cradle comprises a tab for releasably engaging any one of the position slots of the other of the first mounting plate and second mounting plate.

3. The training device of claim 2, wherein:

the respective tab of each of the first arm cradle and second arm cradle comprises a tooth; and the respective tab is biased into an engagement position by which the tooth thereof clicks into a position slot from the any one of the position slots, thereby releasably locking the arm cradle in an indexed position along the respective mounting plate.

4. The training device of claim 3, wherein each tab comprises a lever, by which a user can flex the tab thereby withdrawing the tooth from the position slot to permit movement of the arm cradle on the mounting plate.

5. The training device of claim 4, wherein the arm cradles are constructed as mirror opposites.

6. The training device of claim 4, wherein when the arm cradles are mounted on the mounting plates, the arm cradles are symmetric across the central portion of the frame member.

7. The training device of claim 4, wherein the first mounting plate and second mounting plate are coplanar.

8. The training device of claim 1, wherein:

the first arm cradle comprises a first channel and a second channel, each configured for receiving the user-selected first mounting plate or second mounting plate, the first channel and second channel being angularly offset from each other by an offset angle such that the first arm cradle can be mounted on the frame member in at least two orientations that differ by the offset angle; and the second arm cradle comprises a first channel and a second channel, each configured for receiving the other of the first mounting plate and second mounting plate, the first channel and second channel of the second arm cradle being angularly offset from each other by the offset angle such that the second arm cradle can be mounted on the frame member in at least two orientations that differ by the offset angle.

9. The training device of claim 8, wherein:

the first arm cradle comprises a first tab for engaging any one of the spaced position slots of the user-selected first mounting plate or second mounting plate when the first arm cradle is mounted on the frame member by way of the first channel thereof;

the first arm cradle comprises a second tab for engaging any one of the spaced position slots of the user-selected first mounting plate or second mounting plate when the first arm cradle is mounted on the frame member by way of the second channel thereof;

the second arm cradle comprises a first tab for engaging any one of the spaced position slots of the other one of the first mounting plate and second mounting plate when the second arm cradle is mounted on the frame member by way of the first channel thereof; and the second arm cradle comprises a second tab for engaging any one of the spaced position slots of the other one of the first mounting plate and second mounting plate when the second arm cradle is mounted on the frame member by way of the second channel thereof.

10. The training device of claim 1, further comprising:

an attachment element mounted on the frame member;

a strap having at least one attachment element configured for releasably engaging the attachment element of the frame member, wherein, in use, the attachment element mounted on the frame member and the at least one attachment element of the strap are releasably engaged by the user.

11. The training device of claim 1, further comprising a strap having a proximal end attached to the frame member.

12. The training device of claim 11, wherein:

the strap comprises at least one attachment element configured for releasably engaging the frame member, and a distal end opposite the proximal end; and the frame member comprises at least a first strap slot through which the distal end of the strap is passed to such that the frame member and strap form a loop.

13. The training device of claim 12, wherein the frame member comprises a second strap slot by which the proximal end of the strap is attached to the frame member.

14. The training device of claim 13, wherein:

the first strap slot is defined in a first lateral end of the curved portion of the frame member, from which the first mounting plate extends laterally; and the second strap slot is defined in a second lateral end of the curved portion of the frame member, from which the second mounting plate extends laterally.

15. The training device of claim 14, wherein the first mounting and second mounting plate are coplanar and extend in opposite lateral directions from the respective first lateral end and second lateral end of the frame member.

16. The training device of claim 11, further comprising a pad mounted on the strap.

17. The training device of claim 16, wherein, the training device is configured to be attached to a bench by use of the strap, and the pad adds grip holding the training device securely to the bench.

18. The training device of claim 11, wherein the training device is configured to be worn around the torso or neck of the user by use of the strap.

19. The training device of claim 1, wherein each arm cradle has a respective padded contact area for supporting a respective arm of the user.

* * * * *